US010012235B2

(12) United States Patent
Hörmeyer et al.

(10) Patent No.: US 10,012,235 B2
(45) Date of Patent: Jul. 3, 2018

(54) ROTOR BLADE FOR A COMPRESSOR AND COMPRESSOR HAVING SUCH A ROTOR BLADE

(71) Applicants: Klaus Hörmeyer, Düsseldorf (DE); Bernhard Eisenberg, Bochum (DE); Roland Emmrich, Düsseldorf (DE); Dirk Anding, Bottrop (DE)

(72) Inventors: Klaus Hörmeyer, Düsseldorf (DE); Bernhard Eisenberg, Bochum (DE); Roland Emmrich, Düsseldorf (DE); Dirk Anding, Bottrop (DE)

(73) Assignee: MAN Diesel & Turbo SE, Augsburg (DE)

( * ) Notice: Subject to any disclaimer, the term of this patent is extended or adjusted under 35 U.S.C. 154(b) by 730 days.

(21) Appl. No.: 14/276,602

(22) Filed: May 13, 2014

(65) Prior Publication Data

US 2014/0341745 A1 Nov. 20, 2014

(30) Foreign Application Priority Data

May 14, 2013 (DE) ..... 10 2013 008 145

(51) Int. Cl.
*F04D 29/18* (2006.01)
*F04D 29/32* (2006.01)
(Continued)

(52) U.S. Cl.
CPC ..... *F04D 29/181* (2013.01); *F04D 29/324* (2013.01); *F01D 5/02* (2013.01);
(Continued)

(58) Field of Classification Search
CPC ..... F04D 29/18; F04D 29/324; F04D 29/384; F01D 5/02; F01D 5/282
(Continued)

(56) References Cited

U.S. PATENT DOCUMENTS 3,168,235 A 2/1965 Valdi
3,946,688 A * 3/1976 Gornstein ..... B63B 1/248 114/274
(Continued)

FOREIGN PATENT DOCUMENTS

CN 102094848 6/2011
CN 102384103 3/2012
(Continued)

OTHER PUBLICATIONS

Office Action dated Jan. 24, 2017 which issued in the corresponding Chinese Patent Application No. 201410202105.5.

*Primary Examiner* — Michael R Reid
*Assistant Examiner* — Christopher Ballman
(74) *Attorney, Agent, or Firm* — Cozen O'Connor

(57) ABSTRACT

A rotor blade of an axial compressor includes: a blade root; and a blade leaf. The blade leaf has: a flow inlet edge, a flow outlet edge, a pressure side extending between the flow inlet edge and the flow outlet edge and a suction side extending between the flow inlet edge and the flow outlet edge, which together define a blade profile of the blade leaf in Cartesian coordinate values x, y and z such that first and second profile coordinates, or the coordinates x and y when joining via continuous arcs, each describe a smooth profile section on a radial section height along a third profile coordinate, or the coordinate value z, and the joining of the radial profile sections with a smoothing function describe the blade profile of the blade leaf.

4 Claims, 4 Drawing Sheets

(51) Int. Cl.
*F01D 5/28* (2006.01)
*F04D 29/38* (2006.01)
*F01D 5/02* (2006.01)

(52) U.S. Cl.
CPC ..... *F01D 5/282* (2013.01); *F04D 29/18* (2013.01); *F04D 29/384* (2013.01)

(58) Field of Classification Search
USPC ..... 416/223 R, 243
See application file for complete search history.

(56) References Cited

U.S. PATENT DOCUMENTS 4,519,746 A * 5/1985 Wainauski ..... B64C 11/18 416/223 R
4,652,213 A * 3/1987 Thibert ..... B64C 11/18 244/35 R
4,927,331 A * 5/1990 Vuillet ..... B64C 11/18 416/238
5,474,425 A * 12/1995 Lawlor ..... F03D 1/065 416/223 R
6,722,851 B1 * 4/2004 Brittingham ..... F01D 5/141 415/115
7,530,794 B2 * 5/2009 Sassanelli ..... F01D 5/141 416/241 R
2007/0041841 A1 * 2/2007 Walter ..... F01D 5/141 416/223 R
2007/0231149 A1 * 10/2007 Aynes ..... F01D 5/141 416/223 R
2009/0202354 A1 * 8/2009 Godsk ..... F03D 1/0641 416/223 R
2009/0290987 A1 * 11/2009 Parker ..... F01D 5/141 416/241 R
2010/0209258 A1 * 8/2010 Fuglsang ..... F03D 1/0641 416/90 R
2011/0262281 A1 * 10/2011 Petsche ..... F03D 1/0641 416/223 R
2012/0051901 A1 3/2012 Lanese et al.
2012/0213631 A1 8/2012 Miller et al.

FOREIGN PATENT DOCUMENTS

CN 202176548 3/2012
CN 202209313 5/2012
CN 204402978 6/2015

* cited by examiner

ROTOR BLADE FOR A COMPRESSOR AND COMPRESSOR HAVING SUCH A ROTOR BLADE

CROSS-REFERENCE TO RELATED APPLICATION

This application claims priority to German Application No. DE 102 013 008 145.9, filed May 14, 2014, the content of which is incorporated by reference herein.

BACKGROUND OF THE INVENTION

1. Field of the Invention

The invention relates to a rotor blade for a compressor.

2. Description of the Related Art

Axial compressors typically comprise multiple compressor stages, each compressor stage comprising a rotor blade rim of multiple rotor blades on the rotor side and a guide blade rim of multiple guide blades on the stator side. The rotor blades on the rotor side comprise a blade root and a blade leaf, wherein a rotor blade can be fastened via its blade root to a rotor basic body of the rotor, and wherein the rotor blade has a blade profile which serves for flow deflection. The blade profile of the blade leaf of a rotor blade is defined by a flow inlet edge, a flow outlet edge, a pressure side extending between the flow inlet edge and the flow outlet edge and a suction side of the blade leaf likewise extending between the flow inlet edge and the flow outlet edge. The blade profile of the blade leaf in this case is typically defined in Cartesian or coordinate values x, y and z, namely in such a manner that first and second profile coordinates or the coordinate values x and y on joining the same via continuous arcs or so-called splines each describe a smooth profile section at a radial section height along a third profile coordinate or along the coordinate value z, and that the connection of the radial profile sections with a smoothing function define the blade profile of the blade leaf.

This fundamental construction of a rotor blade is known from U.S. Pat. No. 7,186,090 B2.

The rotor blades known from the prior art all have the disadvantage of having an inadequate choke resistance. During the operation of an axial compressor at the so-called absorption limit of the characteristics diagram, aeroelastic phenomena occur, known as the so-called choke flutter. The choke flutter can cause high mechanical loading of the rotor blades, in particular on rear stages of an axial compressor. Rotor blades not having an adequate choke resistance can be damaged because of this. There is therefore a need for rotor blades with an improved choke resistance, which are resistant in particular with respect to the so-called choke flutter.

SUMMARY OF THE INVENTION

In view of the above problems, an object of the present invention is creating a new type of rotor blade.

According to a first aspect of the invention, this object is solved through a rotor blade in which a maximum profile thickness in the region of each radial profile section lies in a section between 45% and 52% of the length of a camber line extending starting out from the flow inlet edge in the direction of the flow outlet edge and running between the pressure side and the suction side.

According to a second aspect of the invention, the object is solved through a rotor blade in which the pressure side follows an approximately linear course, such that in the region of each radial profile section profile coordinates of the pressure side lie in a tolerance band about a best-fit straight line (i.e., chord) approximating the pressure side, wherein the tolerance band about the best-fit straight line is defined by two straight lines extending parallel to the best-fit straight line and including the best-fit straight line, which from the best-fit straight line have a distance of maximally 0.75 mm each perpendicularly to the best-fit straight line in the region of each radial profile section. According to a third aspect of the invention, the object is solved through a rotor blade in which the blade profile of the blade leaf is described by the profile coordinates of Table 1 shown in the following description such that the blade profile lies within a tolerance range of ±1 mm in a direction perpendicular to each point on the profile defined by the profile coordinates or the coordinate values x, y and z of Table 1, and/or the blade profile coincides with the profile defined by the profile coordinates of Table 1, when all profile coordinates or the coordinate values x, y and z of Table 1 are scaled with a constant value, and/or the blade profile coincides with the profile defined by the profile coordinates of Table 1, when the radial blade length along the third profile coordinate or the coordinate value z is cut off or extrapolated.

With all three abovementioned aspects of the invention it is possible to provide rotor blades with a high choke resistance. Accordingly, the rotor blades according to the invention are insensitive or resistant to choke flutter.

Preferentially two, particularly preferably all three, concepts according to the above-described aspects of the invention are employed combined with one another in order to increase the choke resistance of rotor blades of an axial compressor.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

Preferred further developments of the invention are obtained from the following. Exemplary embodiments of the invention are explained in more detail by the drawings without being restricted to the drawings, in which.

DETAILED DESCRIPTION OF THE PRESENTLY PREFERRED EMBODIMENTS

The present invention relates to a rotor blade on the rotor side of an axial compressor, in particular of a stationary axial compressor for industrial applications.

Figure 1:
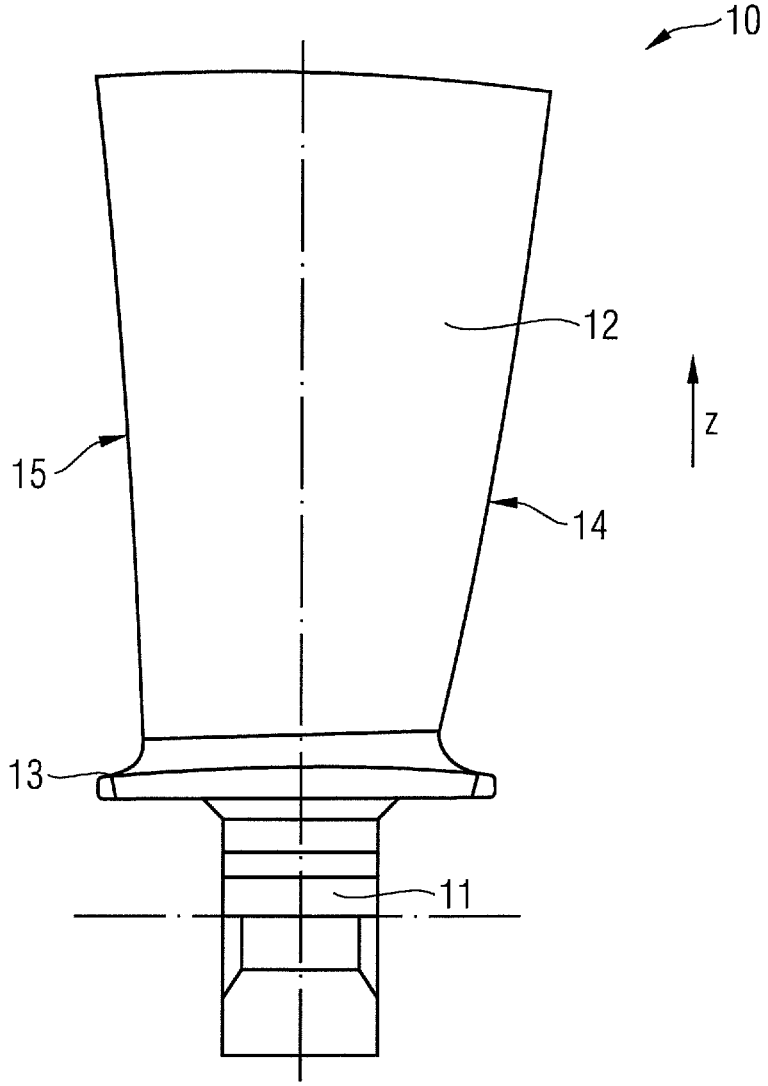
FIG. 1: is a schematic representation of a rotor blade of an axial compressor according to the invention.

FIG. 1 shows a schematic view of a rotor blade 10 according to an exemplary embodiment of the invention, comprising a blade root 11, a blade leaf 12 and a platform 13, which is positioned between the blade root 11 and the blade leaf 12. By way of the blade root 11, the rotor blade 10 can be fastened to a rotor basic body of a rotor of the axial compressor. The blade leaf 12 has a blade profile which serves for flow deflection.

The blade leaf 12 of the rotor blade 10 comprises a flow inlet edge 14, flow outlet edge 15, a pressure side 16 extending between the flow inlet edge 14 and the flow outlet edge 15 and a suction side 17 likewise extending between the flow inlet edge 14 and the flow outlet edge 15. The flow inlet edge 14, the flow outlet edge 15, the pressure side 16 and the suction side 17 of the blade leaf 12 together define the blade profile of the blade leaf 12, wherein the blade profile is typically defined in Cartesian coordinate values x, y and z. The Cartesian coordinate x is the axial profile coordinate, the Cartesian coordinate y is the circumference profile coordinate and the Cartesian coordinate z is the radial profile section height of the rotor blade leaf 12.

Figure 2:
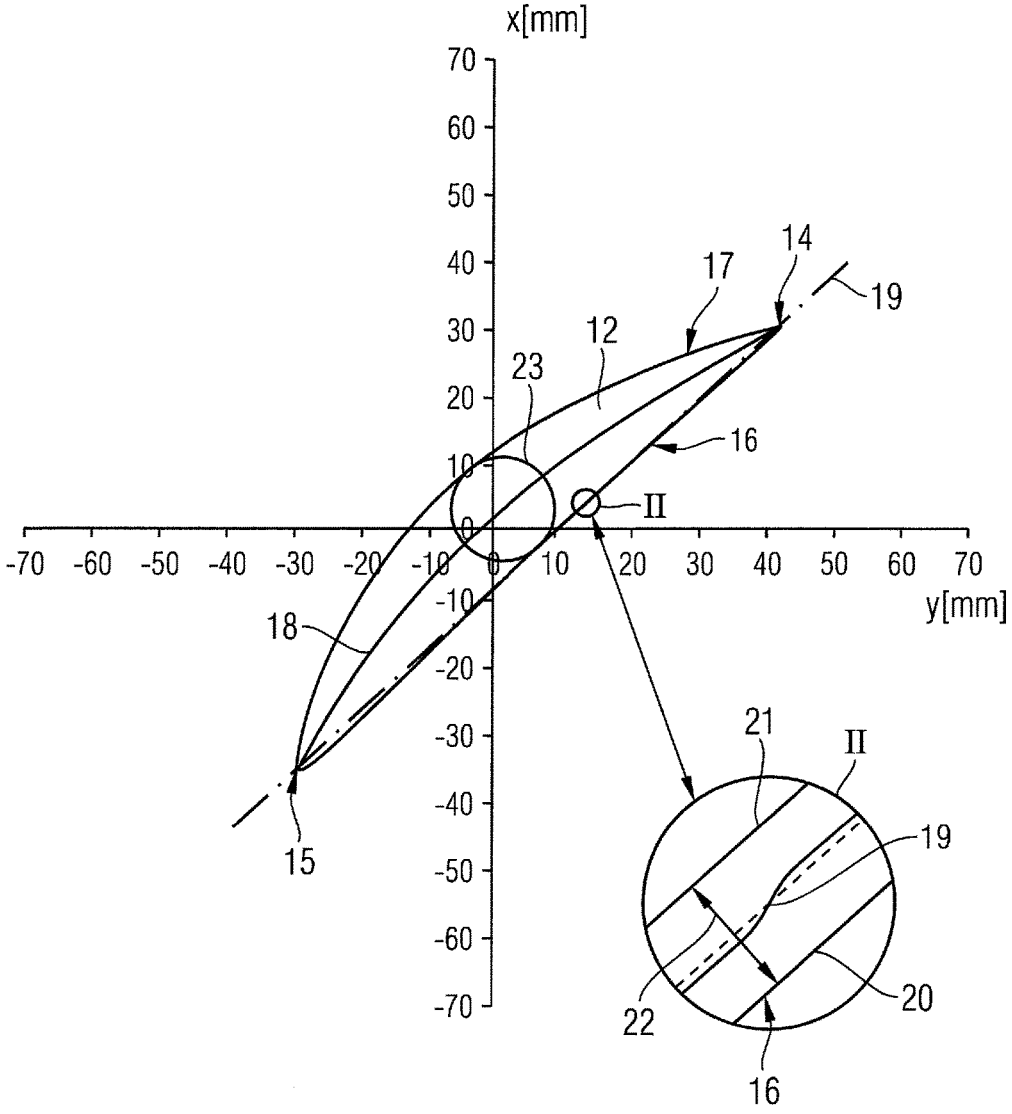
FIG. 2: shows a first, radially inner profile section through the rotor blade according to FIG. 1.
Figure 3:
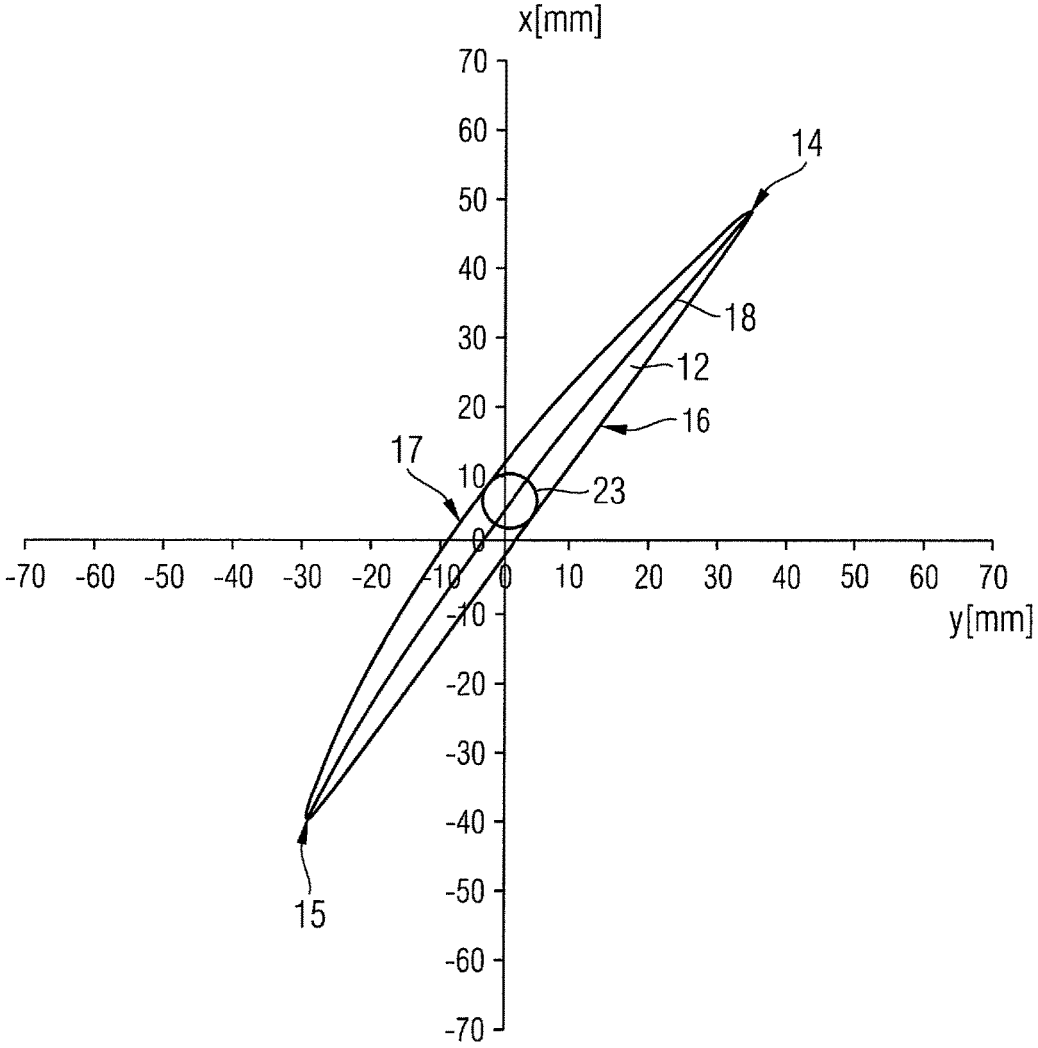
FIG. 3: shows a second, radially middle profile section through the rotor blade according to FIG. 1.
Figure 4:
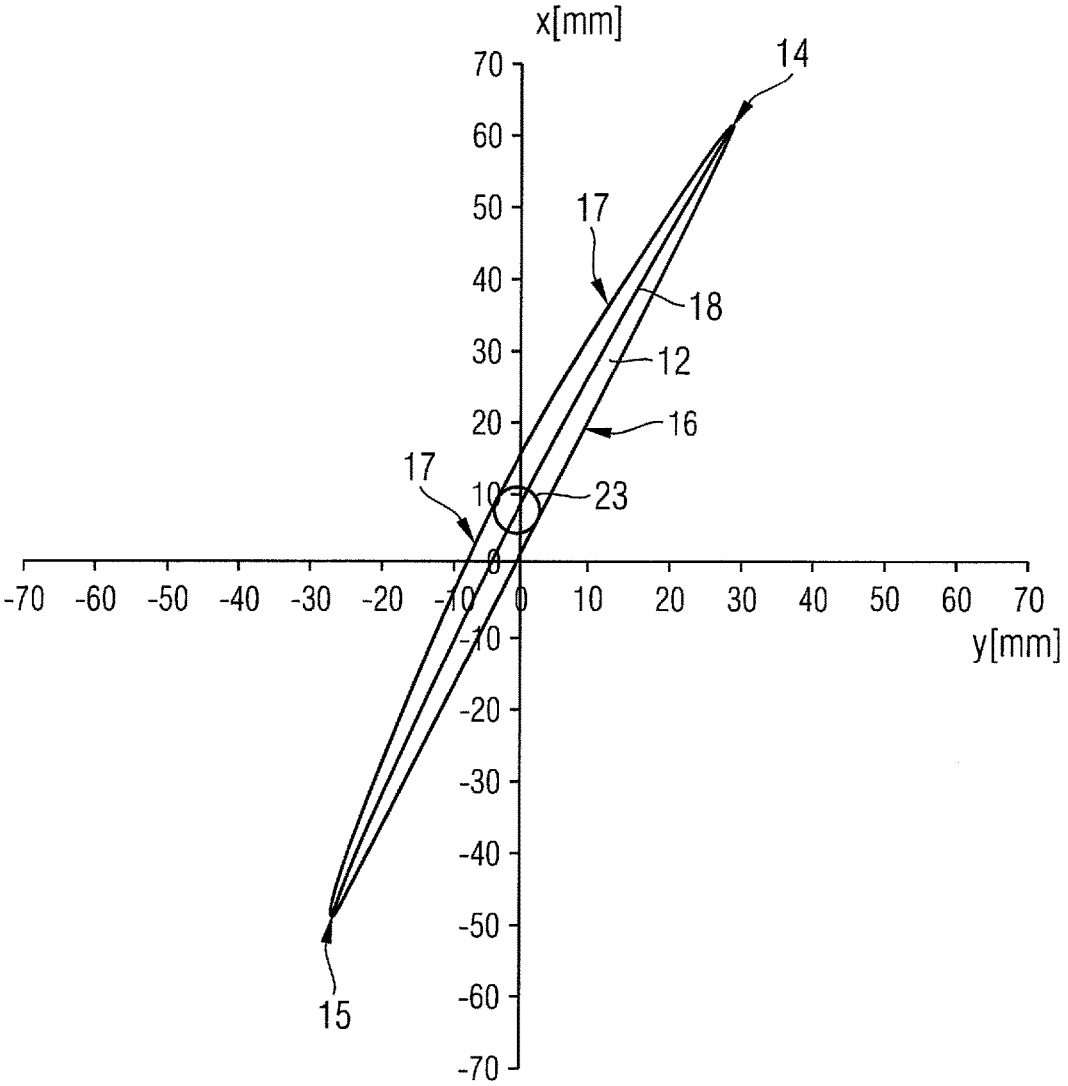
FIG. 4: shows a third, radially outer profile section through the rotor blade according to FIG. 1.

FIG. 1 shows the coordinate z and thus the radial profile section height or the radial extension of the blade leaf 12. FIGS. 2, 3 and 4 show various profile sections through the blade profile of the blade leaf 12 in three different radial section heights z, wherein in FIGS. 2, 3 and 4 the profile coordinates x and y are plotted in millimeters.

As already explained, the blade profile of the blade leaf 12 is defined in Cartesian coordinate values x, y and z. The following Table 1 indicates for a total of nine different radial section heights z the two other profile coordinates or the coordinate values x and y of the blade profile of the blade leaf 12 of the rotor blade 10 according to the invention, wherein the profile coordinates or coordinate values x, y and z compiled in Table 1 define the blade profile of the blade leaf 12 such that first and second profile coordinates or the coordinate values x and y when joined via continuous arcs or splines each describe a smooth profile section on a radial section height along the third profile coordinate or the third coordinate value z, and that the joining of the radial profile sections with smoothing functions define the blade profile of the blade leaf 12.

TABLE 1

| Axial profile coordinate x [mm] | Circumference profile coordinate y [mm] | Radial profile section height z [mm] |
|---|---|---|
| 29.243 | 60.209 | 654.400 |
| 28.325 | 58.382 | 654.400 |
| 27.429 | 56.544 | 654.400 |
| 26.527 | 54.708 | 654.400 |
| 25.624 | 52.874 | 654.400 |
| 24.720 | 51.039 | 654.400 |
| 23.814 | 49.206 | 654.400 |
| 22.905 | 47.374 | 654.400 |
| 21.995 | 45.542 | 654.400 |
| 21.082 | 43.712 | 654.400 |
| 20.168 | 41.883 | 654.400 |
| 19.252 | 40.054 | 654.400 |
| 18.335 | 38.227 | 654.400 |
| 17.417 | 36.399 | 654.400 |
| 16.498 | 34.572 | 654.400 |
| 15.579 | 32.745 | 654.400 |
| 14.659 | 30.919 | 654.400 |
| 13.737 | 29.093 | 654.400 |
| 12.813 | 27.269 | 654.400 |
| 11.888 | 25.445 | 654.400 |
| 10.961 | 23.622 | 654.400 |

TABLE 1-continued

| Axial profile coordinate x [mm] | Circumference profile coordinate y [mm] | Radial profile section height z [mm] |
|---|---|---|
| 10.033 | 21.800 | 654.400 |
| 9.104 | 19.978 | 654.400 |
| 8.174 | 18.157 | 654.400 |
| 7.243 | 16.336 | 654.400 |
| 6.312 | 14.515 | 654.400 |
| 5.380 | 12.694 | 654.400 |
| 4.449 | 10.874 | 654.400 |
| 3.517 | 9.054 | 654.400 |
| 2.585 | 7.233 | 654.400 |
| 1.653 | 5.413 | 654.400 |
| 0.721 | 3.592 | 654.400 |
| −0.211 | 1.772 | 654.400 |
| −1.144 | −0.048 | 654.400 |
| −2.077 | −1.868 | 654.400 |
| −3.010 | −3.687 | 654.400 |
| −3.944 | −5.507 | 654.400 |
| −4.878 | −7.326 | 654.400 |
| −5.812 | −9.146 | 654.400 |
| −6.746 | −10.965 | 654.400 |
| −7.680 | −12.784 | 654.400 |
| −8.614 | −14.603 | 654.400 |
| −9.548 | −16.423 | 654.400 |
| −10.482 | −18.242 | 654.400 |
| −11.416 | −20.061 | 654.400 |
| −12.350 | −21.881 | 654.400 |
| −13.283 | −23.700 | 654.400 |
| −14.217 | −25.520 | 654.400 |
| −15.150 | −27.340 | 654.400 |
| −16.083 | −29.160 | 654.400 |
| −17.015 | −30.980 | 654.400 |
| −17.947 | −32.800 | 654.400 |
| −18.878 | −34.621 | 654.400 |
| −19.809 | −36.442 | 654.400 |
| −20.740 | −38.263 | 654.400 |
| −21.670 | −40.084 | 654.400 |
| −22.599 | −41.906 | 654.400 |
| −23.527 | −43.728 | 654.400 |
| −24.455 | −45.551 | 654.400 |
| −25.382 | −47.373 | 654.400 |
| −25.614 | −47.828 | 654.400 |
| −25.843 | −48.283 | 654.400 |
| −26.080 | −48.734 | 654.400 |
| −26.490 | −49.006 | 654.400 |
| −26.937 | −48.813 | 654.400 |
| −27.038 | −48.329 | 654.400 |
| −26.901 | −47.838 | 654.400 |
| −26.750 | −47.351 | 654.400 |
| −26.595 | −46.865 | 654.400 |
| −25.968 | −44.907 | 654.400 |
| −25.328 | −42.953 | 654.400 |
| −24.664 | −41.006 | 654.400 |
| −23.985 | −39.065 | 654.400 |
| −23.292 | −37.130 | 654.400 |
| −22.585 | −35.199 | 654.400 |
| −21.868 | −33.272 | 654.400 |
| −21.141 | −31.348 | 654.400 |
| −20.405 | −29.428 | 654.400 |
| −19.660 | −27.511 | 654.400 |
| −18.907 | −25.598 | 654.400 |
| −18.145 | −23.688 | 654.400 |
| −17.376 | −21.781 | 654.400 |
| −16.601 | −19.876 | 654.400 |
| −15.818 | −17.974 | 654.400 |
| −15.029 | −16.076 | 654.400 |
| −14.233 | −14.180 | 654.400 |
| −13.429 | −12.287 | 654.400 |
| −12.617 | −10.398 | 654.400 |
| −11.796 | −8.513 | 654.400 |
| −10.966 | −6.631 | 654.400 |
| −10.127 | −4.754 | 654.400 |
| −9.278 | −2.881 | 654.400 |
| −8.419 | −1.013 | 654.400 |
| −7.548 | 0.850 | 654.400 |
| −6.667 | 2.708 | 654.400 |
| −5.775 | 4.561 | 654.400 |

TABLE 1-continued

| Axial profile coordinate x [mm] | Circumference profile coordinate y [mm] | Radial profile section height z [mm] |
|---|---|---|
| −4.870 | 6.407 | 654.400 |
| −3.953 | 8.248 | 654.400 |
| −3.023 | 10.082 | 654.400 |
| −2.081 | 11.910 | 654.400 |
| −1.126 | 13.731 | 654.400 |
| −0.158 | 15.545 | 654.400 |
| 0.822 | 17.353 | 654.400 |
| 1.813 | 19.154 | 654.400 |
| 2.817 | 20.949 | 654.400 |
| 3.832 | 22.738 | 654.400 |
| 4.858 | 24.519 | 654.400 |
| 5.896 | 26.295 | 654.400 |
| 6.945 | 28.064 | 654.400 |
| 8.004 | 29.826 | 654.400 |
| 9.074 | 31.582 | 654.400 |
| 10.154 | 33.332 | 654.400 |
| 11.244 | 35.076 | 654.400 |
| 12.343 | 36.813 | 654.400 |
| 13.451 | 38.546 | 654.400 |
| 14.567 | 40.273 | 654.400 |
| 15.690 | 41.995 | 654.400 |
| 16.821 | 43.713 | 654.400 |
| 17.960 | 45.425 | 654.400 |
| 19.105 | 47.133 | 654.400 |
| 20.258 | 48.835 | 654.400 |
| 21.416 | 50.535 | 654.400 |
| 22.579 | 52.230 | 654.400 |
| 23.748 | 53.923 | 654.400 |
| 24.920 | 55.612 | 654.400 |
| 26.096 | 57.299 | 654.400 |
| 27.274 | 58.984 | 654.400 |
| 28.464 | 60.661 | 654.400 |
| 28.630 | 60.892 | 654.400 |
| 28.789 | 61.128 | 654.400 |
| 28.980 | 61.337 | 654.400 |
| 29.249 | 61.405 | 654.400 |
| 29.489 | 61.266 | 654.400 |
| 29.560 | 60.998 | 654.400 |
| 29.479 | 60.726 | 654.400 |
| 29.365 | 60.466 | 654.400 |
| 29.243 | 60.209 | 654.400 |
| 30.180 | 57.134 | 638.600 |
| 29.257 | 55.379 | 638.600 |
| 28.329 | 53.627 | 638.600 |
| 27.397 | 51.878 | 638.600 |
| 26.461 | 50.130 | 638.600 |
| 25.522 | 48.384 | 638.600 |
| 24.582 | 46.638 | 638.600 |
| 23.641 | 44.893 | 638.600 |
| 22.700 | 43.148 | 638.600 |
| 21.758 | 41.404 | 638.600 |
| 20.814 | 39.660 | 638.600 |
| 19.869 | 37.917 | 638.600 |
| 18.923 | 36.175 | 638.600 |
| 17.976 | 34.433 | 638.600 |
| 17.028 | 32.692 | 638.600 |
| 16.079 | 30.951 | 638.600 |
| 15.129 | 29.211 | 638.600 |
| 14.178 | 27.472 | 638.600 |
| 13.227 | 25.732 | 638.600 |
| 12.274 | 23.994 | 638.600 |
| 11.321 | 22.255 | 638.600 |
| 10.368 | 20.517 | 638.600 |
| 9.413 | 18.779 | 638.600 |
| 8.459 | 17.042 | 638.600 |
| 7.504 | 15.304 | 638.600 |
| 6.549 | 13.567 | 638.600 |
| 5.593 | 11.830 | 638.600 |
| 4.638 | 10.093 | 638.600 |
| 3.682 | 8.356 | 638.600 |
| 2.726 | 6.619 | 638.600 |
| 1.771 | 4.882 | 638.600 |
| 0.815 | 3.144 | 638.600 |
| −0.141 | 1.407 | 638.600 |
| −1.096 | −0.330 | 638.600 |

TABLE 1-continued

| Axial profile coordinate x [mm] | Circumference profile coordinate y [mm] | Radial profile section height z [mm] |
|---|---|---|
| −2.052 | −2.067 | 638.600 |
| −3.007 | −3.804 | 638.600 |
| −3.962 | −5.541 | 638.600 |
| −4.917 | −7.279 | 638.600 |
| −5.872 | −9.016 | 638.600 |
| −6.827 | −10.754 | 638.600 |
| −7.781 | −12.492 | 638.600 |
| −8.735 | −14.230 | 638.600 |
| −9.688 | −15.968 | 638.600 |
| −10.641 | −17.707 | 638.600 |
| −11.593 | −19.445 | 638.600 |
| −12.545 | −21.184 | 638.600 |
| −13.497 | −22.924 | 638.600 |
| −14.448 | −24.663 | 638.600 |
| −15.398 | −26.403 | 638.600 |
| −16.348 | −28.144 | 638.600 |
| −17.297 | −29.884 | 638.600 |
| −18.245 | −31.625 | 638.600 |
| −19.192 | −33.367 | 638.600 |
| −20.139 | −35.109 | 638.600 |
| −21.084 | −36.852 | 638.600 |
| −22.029 | −38.594 | 638.600 |
| −22.973 | −40.338 | 638.600 |
| −23.916 | −42.082 | 638.600 |
| −24.858 | −43.826 | 638.600 |
| −25.799 | −45.572 | 638.600 |
| −26.030 | −46.010 | 638.600 |
| −26.265 | −46.446 | 638.600 |
| −26.530 | −46.865 | 638.600 |
| −26.962 | −47.074 | 638.600 |
| −27.397 | −46.869 | 638.600 |
| −27.529 | −46.405 | 638.600 |
| −27.405 | −45.926 | 638.600 |
| −27.249 | −45.456 | 638.600 |
| −27.089 | −44.986 | 638.600 |
| −26.445 | −43.099 | 638.600 |
| −25.782 | −41.217 | 638.600 |
| −25.102 | −39.343 | 638.600 |
| −24.405 | −37.474 | 638.600 |
| −23.694 | −35.610 | 638.600 |
| −22.969 | −33.752 | 638.600 |
| −22.232 | −31.898 | 638.600 |
| −21.485 | −30.049 | 638.600 |
| −20.728 | −28.204 | 638.600 |
| −19.962 | −26.362 | 638.600 |
| −19.188 | −24.524 | 638.600 |
| −18.405 | −22.689 | 638.600 |
| −17.615 | −20.858 | 638.600 |
| −16.816 | −19.030 | 638.600 |
| −16.011 | −17.206 | 638.600 |
| −15.197 | −15.384 | 638.600 |
| −14.376 | −13.567 | 638.600 |
| −13.546 | −11.753 | 638.600 |
| −12.707 | −9.943 | 638.600 |
| −11.859 | −8.138 | 638.600 |
| −11.002 | −6.337 | 638.600 |
| −10.135 | −4.541 | 638.600 |
| −9.257 | −2.750 | 638.600 |
| −8.370 | −0.964 | 638.600 |
| −7.471 | 0.817 | 638.600 |
| −6.561 | 2.592 | 638.600 |
| −5.640 | 4.361 | 638.600 |
| −4.706 | 6.124 | 638.600 |
| −3.761 | 7.880 | 638.600 |
| −2.803 | 9.630 | 638.600 |
| −1.833 | 11.372 | 638.600 |
| −0.850 | 13.108 | 638.600 |
| 0.145 | 14.837 | 638.600 |
| 1.152 | 16.558 | 638.600 |
| 2.171 | 18.273 | 638.600 |
| 3.202 | 19.981 | 638.600 |
| 4.243 | 21.682 | 638.600 |
| 5.296 | 23.376 | 638.600 |
| 6.359 | 25.064 | 638.600 |
| 7.433 | 26.744 | 638.600 |

TABLE 1-continued

| Axial profile coordinate x [mm] | Circumference profile coordinate y [mm] | Radial profile section height z [mm] |
|---|---|---|
| 8.517 | 28.419 | 638.600 |
| 9.611 | 30.086 | 638.600 |
| 10.715 | 31.747 | 638.600 |
| 11.829 | 33.402 | 638.600 |
| 12.952 | 35.051 | 638.600 |
| 14.083 | 36.694 | 638.600 |
| 15.223 | 38.331 | 638.600 |
| 16.370 | 39.962 | 638.600 |
| 17.525 | 41.588 | 638.600 |
| 18.687 | 43.209 | 638.600 |
| 19.856 | 44.825 | 638.600 |
| 21.032 | 46.437 | 638.600 |
| 22.213 | 48.044 | 638.600 |
| 23.401 | 49.646 | 638.600 |
| 24.593 | 51.245 | 638.600 |
| 25.790 | 52.841 | 638.600 |
| 26.989 | 54.435 | 638.600 |
| 28.194 | 56.024 | 638.600 |
| 29.410 | 57.605 | 638.600 |
| 29.578 | 57.823 | 638.600 |
| 29.743 | 58.042 | 638.600 |
| 29.942 | 58.229 | 638.600 |
| 30.206 | 58.277 | 638.600 |
| 30.437 | 58.137 | 638.600 |
| 30.516 | 57.881 | 638.600 |
| 30.437 | 57.619 | 638.600 |
| 30.310 | 57.376 | 638.600 |
| 30.180 | 57.134 | 638.600 |
| −26.387 | −43.186 | 615.300 |
| −25.411 | −41.538 | 615.300 |
| −24.434 | −39.889 | 615.300 |
| −23.458 | −38.241 | 615.300 |
| −22.482 | −36.593 | 615.300 |
| −21.506 | −34.945 | 615.300 |
| −20.530 | −33.297 | 615.300 |
| −19.553 | −31.650 | 615.300 |
| −18.575 | −30.002 | 615.300 |
| −17.597 | −28.355 | 615.300 |
| −16.619 | −26.709 | 615.300 |
| −15.639 | −25.062 | 615.300 |
| −14.659 | −23.417 | 615.300 |
| −13.678 | −21.772 | 615.300 |
| −12.695 | −20.127 | 615.300 |
| −11.712 | −18.484 | 615.300 |
| −10.727 | −16.841 | 615.300 |
| −9.742 | −15.198 | 615.300 |
| −8.756 | −13.556 | 615.300 |
| −7.769 | −11.914 | 615.300 |
| −6.782 | −10.272 | 615.300 |
| −5.794 | −8.631 | 615.300 |
| −4.806 | −6.991 | 615.300 |
| −3.816 | −5.350 | 615.300 |
| −2.827 | −3.710 | 615.300 |
| −1.837 | −2.071 | 615.300 |
| −0.846 | −0.431 | 615.300 |
| 0.145 | 1.208 | 615.300 |
| 1.137 | 2.847 | 615.300 |
| 2.129 | 4.485 | 615.300 |
| 3.122 | 6.124 | 615.300 |
| 4.115 | 7.762 | 615.300 |
| 5.108 | 9.400 | 615.300 |
| 6.101 | 11.037 | 615.300 |
| 7.095 | 12.675 | 615.300 |
| 8.089 | 14.312 | 615.300 |
| 9.083 | 15.950 | 615.300 |
| 10.077 | 17.587 | 615.300 |
| 11.071 | 19.225 | 615.300 |
| 12.065 | 20.862 | 615.300 |
| 13.059 | 22.500 | 615.300 |
| 14.052 | 24.137 | 615.300 |
| 15.045 | 25.775 | 615.300 |
| 16.038 | 27.413 | 615.300 |
| 17.031 | 29.051 | 615.300 |
| 18.023 | 30.690 | 615.300 |
| 19.016 | 32.328 | 615.300 |

TABLE 1-continued

| Axial profile coordinate x [mm] | Circumference profile coordinate y [mm] | Radial profile section height z [mm] |
|---|---|---|
| 20.007 | 33.967 | 615.300 |
| 20.998 | 35.606 | 615.300 |
| 21.989 | 37.246 | 615.300 |
| 22.978 | 38.886 | 615.300 |
| 23.967 | 40.526 | 615.300 |
| 24.954 | 42.168 | 615.300 |
| 25.941 | 43.809 | 615.300 |
| 26.927 | 45.452 | 615.300 |
| 27.912 | 47.095 | 615.300 |
| 28.896 | 48.738 | 615.300 |
| 29.881 | 50.381 | 615.300 |
| 30.863 | 52.025 | 615.300 |
| 31.839 | 53.674 | 615.300 |
| 31.978 | 53.899 | 615.300 |
| 32.105 | 54.130 | 615.300 |
| 32.174 | 54.384 | 615.300 |
| 32.092 | 54.630 | 615.300 |
| 31.877 | 54.776 | 615.300 |
| 31.618 | 54.761 | 615.300 |
| 31.406 | 54.606 | 615.300 |
| 31.230 | 54.409 | 615.300 |
| 31.061 | 54.205 | 615.300 |
| 29.802 | 52.744 | 615.300 |
| 28.553 | 51.273 | 615.300 |
| 27.312 | 49.797 | 615.300 |
| 26.074 | 48.318 | 615.300 |
| 24.840 | 46.835 | 615.300 |
| 23.612 | 45.347 | 615.300 |
| 22.390 | 43.854 | 615.300 |
| 21.175 | 42.356 | 615.300 |
| 19.967 | 40.852 | 615.300 |
| 18.766 | 39.343 | 615.300 |
| 17.572 | 37.828 | 615.300 |
| 16.385 | 36.307 | 615.300 |
| 15.207 | 34.779 | 615.300 |
| 14.038 | 33.245 | 615.300 |
| 12.877 | 31.705 | 615.300 |
| 11.725 | 30.157 | 615.300 |
| 10.583 | 28.603 | 615.300 |
| 9.450 | 27.041 | 615.300 |
| 8.327 | 25.473 | 615.300 |
| 7.215 | 23.897 | 615.300 |
| 6.113 | 22.313 | 615.300 |
| 5.021 | 20.723 | 615.300 |
| 3.941 | 19.125 | 615.300 |
| 2.871 | 17.520 | 615.300 |
| 1.812 | 15.907 | 615.300 |
| 0.765 | 14.287 | 615.300 |
| −0.270 | 12.659 | 615.300 |
| −1.293 | 11.024 | 615.300 |
| −2.305 | 9.382 | 615.300 |
| −3.303 | 7.731 | 615.300 |
| −4.290 | 6.074 | 615.300 |
| −5.265 | 4.409 | 615.300 |
| −6.228 | 2.738 | 615.300 |
| −7.180 | 1.060 | 615.300 |
| −8.121 | −0.624 | 615.300 |
| −9.052 | −2.314 | 615.300 |
| −9.972 | −4.009 | 615.300 |
| −10.881 | −5.710 | 615.300 |
| −11.781 | −7.417 | 615.300 |
| −12.672 | −9.128 | 615.300 |
| −13.553 | −10.844 | 615.300 |
| −14.426 | −12.564 | 615.300 |
| −15.289 | −14.289 | 615.300 |
| −16.145 | −16.018 | 615.300 |
| −16.993 | −17.751 | 615.300 |
| −17.833 | −19.487 | 615.300 |
| −18.665 | −21.227 | 615.300 |
| −19.488 | −22.972 | 615.300 |
| −20.303 | −24.720 | 615.300 |
| −21.108 | −26.473 | 615.300 |
| −21.904 | −28.231 | 615.300 |
| −22.689 | −29.993 | 615.300 |
| −23.465 | −31.759 | 615.300 |

TABLE 1-continued

| Axial profile coordinate x [mm] | Circumference profile coordinate y [mm] | Radial profile section height z [mm] |
|---|---|---|
| −24.229 | −33.530 | 615.300 |
| −24.979 | −35.307 | 615.300 |
| −25.713 | −37.091 | 615.300 |
| −26.427 | −38.883 | 615.300 |
| −27.121 | −40.683 | 615.300 |
| −27.790 | −42.492 | 615.300 |
| −27.957 | −42.942 | 615.300 |
| −28.118 | −43.394 | 615.300 |
| −28.214 | −43.861 | 615.300 |
| −28.043 | −44.297 | 615.300 |
| −27.624 | −44.511 | 615.300 |
| −27.175 | −44.381 | 615.300 |
| −26.874 | −44.012 | 615.300 |
| −26.629 | −43.599 | 615.300 |
| −26.387 | −43.186 | 615.300 |
| −26.914 | −41.338 | 592.500 |
| −25.897 | −39.776 | 592.500 |
| −24.882 | −38.212 | 592.500 |
| −23.868 | −36.647 | 592.500 |
| −22.855 | −35.083 | 592.500 |
| −21.842 | −33.517 | 592.500 |
| −20.828 | −31.953 | 592.500 |
| −19.813 | −30.389 | 592.500 |
| −18.797 | −28.826 | 592.500 |
| −17.780 | −27.263 | 592.500 |
| −16.762 | −25.701 | 592.500 |
| −15.743 | −24.140 | 592.500 |
| −14.724 | −22.579 | 592.500 |
| −13.704 | −21.018 | 592.500 |
| −12.684 | −19.458 | 592.500 |
| −11.663 | −17.898 | 592.500 |
| −10.641 | −16.339 | 592.500 |
| −9.618 | −14.780 | 592.500 |
| −8.594 | −13.222 | 592.500 |
| −7.570 | −11.664 | 592.500 |
| −6.546 | −10.106 | 592.500 |
| −5.520 | −8.549 | 592.500 |
| −4.494 | −6.992 | 592.500 |
| −3.468 | −5.436 | 592.500 |
| −2.441 | −3.880 | 592.500 |
| −1.414 | −2.324 | 592.500 |
| −0.386 | −0.769 | 592.500 |
| 0.643 | 0.786 | 592.500 |
| 1.671 | 2.341 | 592.500 |
| 2.700 | 3.896 | 592.500 |
| 3.730 | 5.450 | 592.500 |
| 4.760 | 7.004 | 592.500 |
| 5.790 | 8.558 | 592.500 |
| 6.821 | 10.111 | 592.500 |
| 7.853 | 11.664 | 592.500 |
| 8.884 | 13.217 | 592.500 |
| 9.917 | 14.770 | 592.500 |
| 10.949 | 16.322 | 592.500 |
| 11.982 | 17.875 | 592.500 |
| 13.014 | 19.427 | 592.500 |
| 14.047 | 20.979 | 592.500 |
| 15.080 | 22.531 | 592.500 |
| 16.113 | 24.083 | 592.500 |
| 17.147 | 25.635 | 592.500 |
| 18.180 | 27.187 | 592.500 |
| 19.213 | 28.739 | 592.500 |
| 20.245 | 30.291 | 592.500 |
| 21.278 | 31.843 | 592.500 |
| 22.310 | 33.395 | 592.500 |
| 23.343 | 34.948 | 592.500 |
| 24.375 | 36.501 | 592.500 |
| 25.406 | 38.054 | 592.500 |
| 26.437 | 39.607 | 592.500 |
| 27.468 | 41.161 | 592.500 |
| 28.498 | 42.715 | 592.500 |
| 29.527 | 44.269 | 592.500 |
| 30.556 | 45.824 | 592.500 |
| 31.585 | 47.379 | 592.500 |
| 32.612 | 48.934 | 592.500 |
| 33.639 | 50.490 | 592.500 |

TABLE 1-continued

| Axial profile coordinate x [mm] | Circumference profile coordinate y [mm] | Radial profile section height z [mm] |
|---|---|---|
| 33.781 | 50.705 | 592.500 |
| 33.914 | 50.925 | 592.500 |
| 33.978 | 51.172 | 592.500 |
| 33.899 | 51.412 | 592.500 |
| 33.696 | 51.565 | 592.500 |
| 33.443 | 51.576 | 592.500 |
| 33.221 | 51.451 | 592.500 |
| 33.037 | 51.271 | 592.500 |
| 32.859 | 51.085 | 592.500 |
| 31.549 | 49.735 | 592.500 |
| 30.244 | 48.380 | 592.500 |
| 28.945 | 47.019 | 592.500 |
| 27.652 | 45.653 | 592.500 |
| 26.365 | 44.281 | 592.500 |
| 25.084 | 42.904 | 592.500 |
| 23.810 | 41.520 | 592.500 |
| 22.542 | 40.130 | 592.500 |
| 21.281 | 38.734 | 592.500 |
| 20.028 | 37.332 | 592.500 |
| 18.782 | 35.922 | 592.500 |
| 17.544 | 34.506 | 592.500 |
| 16.314 | 33.083 | 592.500 |
| 15.092 | 31.653 | 592.500 |
| 13.879 | 30.215 | 592.500 |
| 12.674 | 28.770 | 592.500 |
| 11.479 | 27.318 | 592.500 |
| 10.293 | 25.858 | 592.500 |
| 9.117 | 24.390 | 592.500 |
| 7.950 | 22.914 | 592.500 |
| 6.794 | 21.430 | 592.500 |
| 5.649 | 19.938 | 592.500 |
| 4.514 | 18.437 | 592.500 |
| 3.391 | 16.928 | 592.500 |
| 2.279 | 15.411 | 592.500 |
| 1.179 | 13.885 | 592.500 |
| 0.091 | 12.351 | 592.500 |
| −0.985 | 10.808 | 592.500 |
| −2.048 | 9.256 | 592.500 |
| −3.098 | 7.695 | 592.500 |
| −4.135 | 6.126 | 592.500 |
| −5.160 | 4.548 | 592.500 |
| −6.172 | 2.963 | 592.500 |
| −7.172 | 1.369 | 592.500 |
| −8.161 | −0.231 | 592.500 |
| −9.137 | −1.839 | 592.500 |
| −10.102 | −3.454 | 592.500 |
| −11.055 | −5.075 | 592.500 |
| −11.998 | −6.703 | 592.500 |
| −12.930 | −8.338 | 592.500 |
| −13.851 | −9.978 | 592.500 |
| −14.761 | −11.624 | 592.500 |
| −15.661 | −13.276 | 592.500 |
| −16.552 | −14.933 | 592.500 |
| −17.432 | −16.595 | 592.500 |
| −18.302 | −18.263 | 592.500 |
| −19.163 | −19.936 | 592.500 |
| −20.012 | −21.614 | 592.500 |
| −20.850 | −23.298 | 592.500 |
| −21.677 | −24.987 | 592.500 |
| −22.492 | −26.683 | 592.500 |
| −23.295 | −28.384 | 592.500 |
| −24.085 | −30.091 | 592.500 |
| −24.861 | −31.805 | 592.500 |
| −25.619 | −33.526 | 592.500 |
| −26.359 | −35.256 | 592.500 |
| −27.076 | −36.995 | 592.500 |
| −27.770 | −38.743 | 592.500 |
| −28.437 | −40.502 | 592.500 |
| −28.606 | −40.939 | 592.500 |
| −28.759 | −41.381 | 592.500 |
| −28.819 | −41.842 | 592.500 |
| −28.632 | −42.262 | 592.500 |
| −28.230 | −42.487 | 592.500 |
| −27.775 | −42.427 | 592.500 |
| −27.426 | −42.121 | 592.500 |

TABLE 1-continued

| Axial profile coordinate x [mm] | Circumference profile coordinate y [mm] | Radial profile section height z [mm] |
|---|---|---|
| −27.161 | −41.736 | 592.500 |
| −26.914 | −41.338 | 592.500 |
| −27.322 | −40.054 | 569.700 |
| −26.268 | −38.575 | 569.700 |
| −25.215 | −37.095 | 569.700 |
| −24.161 | −35.616 | 569.700 |
| −23.108 | −34.136 | 569.700 |
| −22.055 | −32.656 | 569.700 |
| −21.002 | −31.176 | 569.700 |
| −19.948 | −29.696 | 569.700 |
| −18.894 | −28.217 | 569.700 |
| −17.840 | −26.738 | 569.700 |
| −16.785 | −25.259 | 569.700 |
| −15.729 | −23.781 | 569.700 |
| −14.673 | −22.303 | 569.700 |
| −13.615 | −20.826 | 569.700 |
| −12.557 | −19.350 | 569.700 |
| −11.498 | −17.874 | 569.700 |
| −10.437 | −16.399 | 569.700 |
| −9.376 | −14.925 | 569.700 |
| −8.314 | −13.451 | 569.700 |
| −7.252 | −11.978 | 569.700 |
| −6.189 | −10.505 | 569.700 |
| −5.125 | −9.033 | 569.700 |
| −4.061 | −7.561 | 569.700 |
| −2.996 | −6.090 | 569.700 |
| −1.930 | −4.618 | 569.700 |
| −0.864 | −3.148 | 569.700 |
| 0.202 | −1.677 | 569.700 |
| 1.269 | −0.207 | 569.700 |
| 2.337 | 1.263 | 569.700 |
| 3.405 | 2.732 | 569.700 |
| 4.473 | 4.201 | 569.700 |
| 5.541 | 5.670 | 569.700 |
| 6.610 | 7.139 | 569.700 |
| 7.679 | 8.608 | 569.700 |
| 8.748 | 10.076 | 569.700 |
| 9.817 | 11.544 | 569.700 |
| 10.887 | 13.013 | 569.700 |
| 11.957 | 14.481 | 569.700 |
| 13.026 | 15.949 | 569.700 |
| 14.096 | 17.417 | 569.700 |
| 15.166 | 18.885 | 569.700 |
| 16.235 | 20.353 | 569.700 |
| 17.305 | 21.821 | 569.700 |
| 18.374 | 23.289 | 569.700 |
| 19.444 | 24.758 | 569.700 |
| 20.513 | 26.226 | 569.700 |
| 21.582 | 27.695 | 569.700 |
| 22.650 | 29.164 | 569.700 |
| 23.719 | 30.633 | 569.700 |
| 24.787 | 32.102 | 569.700 |
| 25.854 | 33.572 | 569.700 |
| 26.921 | 35.042 | 569.700 |
| 27.987 | 36.513 | 569.700 |
| 29.052 | 37.984 | 569.700 |
| 30.117 | 39.455 | 569.700 |
| 31.182 | 40.927 | 569.700 |
| 32.244 | 42.401 | 569.700 |
| 33.303 | 43.877 | 569.700 |
| 34.362 | 45.352 | 569.700 |
| 35.428 | 46.823 | 569.700 |
| 35.578 | 47.024 | 569.700 |
| 35.709 | 47.238 | 569.700 |
| 35.765 | 47.480 | 569.700 |
| 35.695 | 47.718 | 569.700 |
| 35.507 | 47.879 | 569.700 |
| 35.261 | 47.911 | 569.700 |
| 35.030 | 47.820 | 569.700 |
| 34.834 | 47.664 | 569.700 |
| 34.650 | 47.492 | 569.700 |
| 33.284 | 46.260 | 569.700 |
| 31.920 | 45.024 | 569.700 |
| 30.560 | 43.785 | 569.700 |
| 29.203 | 42.542 | 569.700 |

TABLE 1-continued

| Axial profile coordinate x [mm] | Circumference profile coordinate y [mm] | Radial profile section height z [mm] |
|---|---|---|
| 27.852 | 41.293 | 569.700 |
| 26.506 | 40.038 | 569.700 |
| 25.167 | 38.777 | 569.700 |
| 23.834 | 37.508 | 569.700 |
| 22.509 | 36.231 | 569.700 |
| 21.190 | 34.948 | 569.700 |
| 19.879 | 33.657 | 569.700 |
| 18.575 | 32.359 | 569.700 |
| 17.279 | 31.053 | 569.700 |
| 15.991 | 29.738 | 569.700 |
| 14.712 | 28.416 | 569.700 |
| 13.442 | 27.084 | 569.700 |
| 12.182 | 25.743 | 569.700 |
| 10.932 | 24.393 | 569.700 |
| 9.692 | 23.034 | 569.700 |
| 8.462 | 21.665 | 569.700 |
| 7.244 | 20.286 | 569.700 |
| 6.037 | 18.897 | 569.700 |
| 4.842 | 17.498 | 569.700 |
| 3.659 | 16.089 | 569.700 |
| 2.488 | 14.669 | 569.700 |
| 1.330 | 13.239 | 569.700 |
| 0.185 | 11.798 | 569.700 |
| −0.946 | 10.347 | 569.700 |
| −2.063 | 8.885 | 569.700 |
| −3.166 | 7.412 | 569.700 |
| −4.255 | 5.929 | 569.700 |
| −5.330 | 4.435 | 569.700 |
| −6.390 | 2.931 | 569.700 |
| −7.436 | 1.418 | 569.700 |
| −8.468 | −0.106 | 569.700 |
| −9.486 | −1.639 | 569.700 |
| −10.489 | −3.181 | 569.700 |
| −11.479 | −4.732 | 569.700 |
| −12.456 | −6.292 | 569.700 |
| −13.419 | −7.860 | 569.700 |
| −14.369 | −9.435 | 569.700 |
| −15.306 | −11.019 | 569.700 |
| −16.231 | −12.610 | 569.700 |
| −17.143 | −14.208 | 569.700 |
| −18.042 | −15.813 | 569.700 |
| −18.929 | −17.426 | 569.700 |
| −19.803 | −19.045 | 569.700 |
| −20.663 | −20.671 | 569.700 |
| −21.509 | −22.305 | 569.700 |
| −22.341 | −23.947 | 569.700 |
| −23.157 | −25.596 | 569.700 |
| −23.958 | −27.252 | 569.700 |
| −24.742 | −28.917 | 569.700 |
| −25.509 | −30.590 | 569.700 |
| −26.254 | −32.272 | 569.700 |
| −26.977 | −33.964 | 569.700 |
| −27.674 | −35.667 | 569.700 |
| −28.343 | −37.381 | 569.700 |
| −28.981 | −39.107 | 569.700 |
| −29.143 | −39.534 | 569.700 |
| −29.276 | −39.971 | 569.700 |
| −29.291 | −40.424 | 569.700 |
| −29.082 | −40.824 | 569.700 |
| −28.692 | −41.052 | 569.700 |
| −28.243 | −41.038 | 569.700 |
| −27.866 | −40.787 | 569.700 |
| −27.579 | −40.432 | 569.700 |
| −27.322 | −40.054 | 569.700 |
| −27.549 | −38.858 | 550.700 |
| −26.469 | −37.455 | 550.700 |
| −25.384 | −36.056 | 550.700 |
| −24.296 | −34.658 | 550.700 |
| −23.210 | −33.260 | 550.700 |
| −22.125 | −31.861 | 550.700 |
| −21.039 | −30.462 | 550.700 |
| −19.952 | −29.064 | 550.700 |
| −18.865 | −27.666 | 550.700 |
| −17.778 | −26.269 | 550.700 |
| −16.690 | −24.872 | 550.700 |

TABLE 1-continued

| Axial profile coordinate x [mm] | Circumference profile coordinate y [mm] | Radial profile section height z [mm] |
|---|---|---|
| −15.602 | −23.475 | 550.700 |
| −14.513 | −22.078 | 550.700 |
| −13.424 | −20.682 | 550.700 |
| −12.334 | −19.286 | 550.700 |
| −11.244 | −17.891 | 550.700 |
| −10.154 | −16.496 | 550.700 |
| −9.063 | −15.101 | 550.700 |
| −7.972 | −13.706 | 550.700 |
| −6.880 | −12.312 | 550.700 |
| −5.789 | −10.918 | 550.700 |
| −4.697 | −9.524 | 550.700 |
| −3.604 | −8.131 | 550.700 |
| −2.512 | −6.737 | 550.700 |
| −1.419 | −5.344 | 550.700 |
| −0.326 | −3.951 | 550.700 |
| 0.768 | −2.558 | 550.700 |
| 1.861 | −1.166 | 550.700 |
| 2.955 | 0.227 | 550.700 |
| 4.049 | 1.619 | 550.700 |
| 5.143 | 3.012 | 550.700 |
| 6.237 | 4.404 | 550.700 |
| 7.331 | 5.796 | 550.700 |
| 8.426 | 7.188 | 550.700 |
| 9.521 | 8.580 | 550.700 |
| 10.615 | 9.972 | 550.700 |
| 11.710 | 11.363 | 550.700 |
| 12.805 | 12.755 | 550.700 |
| 13.900 | 14.147 | 550.700 |
| 14.994 | 15.538 | 550.700 |
| 16.089 | 16.930 | 550.700 |
| 17.184 | 18.322 | 550.700 |
| 18.278 | 19.714 | 550.700 |
| 19.373 | 21.106 | 550.700 |
| 20.467 | 22.498 | 550.700 |
| 21.561 | 23.890 | 550.700 |
| 22.655 | 25.282 | 550.700 |
| 23.749 | 26.675 | 550.700 |
| 24.842 | 28.068 | 550.700 |
| 25.935 | 29.461 | 550.700 |
| 27.027 | 30.854 | 550.700 |
| 28.119 | 32.248 | 550.700 |
| 29.211 | 33.643 | 550.700 |
| 30.302 | 35.038 | 550.700 |
| 31.392 | 36.433 | 550.700 |
| 32.481 | 37.829 | 550.700 |
| 33.570 | 39.225 | 550.700 |
| 34.658 | 40.622 | 550.700 |
| 35.742 | 42.023 | 550.700 |
| 36.830 | 43.419 | 550.700 |
| 36.985 | 43.612 | 550.700 |
| 37.118 | 43.819 | 550.700 |
| 37.174 | 44.057 | 550.700 |
| 37.105 | 44.290 | 550.700 |
| 36.927 | 44.458 | 550.700 |
| 36.690 | 44.514 | 550.700 |
| 36.455 | 44.446 | 550.700 |
| 36.251 | 44.308 | 550.700 |
| 36.056 | 44.157 | 550.700 |
| 34.629 | 43.053 | 550.700 |
| 33.202 | 41.950 | 550.700 |
| 31.778 | 40.843 | 550.700 |
| 30.360 | 39.728 | 550.700 |
| 28.948 | 38.605 | 550.700 |
| 27.542 | 37.476 | 550.700 |
| 26.141 | 36.339 | 550.700 |
| 24.747 | 35.195 | 550.700 |
| 23.359 | 34.043 | 550.700 |
| 21.978 | 32.883 | 550.700 |
| 20.604 | 31.714 | 550.700 |
| 19.237 | 30.537 | 550.700 |
| 17.879 | 29.350 | 550.700 |
| 16.528 | 28.154 | 550.700 |
| 15.187 | 26.948 | 550.700 |
| 13.855 | 25.732 | 550.700 |
| 12.533 | 24.504 | 550.700 |

TABLE 1-continued

| Axial profile coordinate x [mm] | Circumference profile coordinate y [mm] | Radial profile section height z [mm] |
|---|---|---|
| 11.221 | 23.266 | 550.700 |
| 9.921 | 22.017 | 550.700 |
| 8.631 | 20.755 | 550.700 |
| 7.353 | 19.482 | 550.700 |
| 6.088 | 18.197 | 550.700 |
| 4.835 | 16.899 | 550.700 |
| 3.596 | 15.588 | 550.700 |
| 2.370 | 14.265 | 550.700 |
| 1.159 | 12.929 | 550.700 |
| −0.038 | 11.579 | 550.700 |
| −1.219 | 10.216 | 550.700 |
| −2.385 | 8.839 | 550.700 |
| −3.534 | 7.449 | 550.700 |
| −4.666 | 6.045 | 550.700 |
| −5.782 | 4.627 | 550.700 |
| −6.881 | 3.197 | 550.700 |
| −7.963 | 1.754 | 550.700 |
| −9.029 | 0.298 | 550.700 |
| −10.077 | −1.169 | 550.700 |
| −11.109 | −2.649 | 550.700 |
| −12.125 | −4.140 | 550.700 |
| −13.123 | −5.642 | 550.700 |
| −14.105 | −7.155 | 550.700 |
| −15.070 | −8.678 | 550.700 |
| −16.019 | −10.213 | 550.700 |
| −16.952 | −11.757 | 550.700 |
| −17.868 | −13.310 | 550.700 |
| −18.768 | −14.874 | 550.700 |
| −19.652 | −16.446 | 550.700 |
| −20.519 | −18.028 | 550.700 |
| −21.369 | −19.619 | 550.700 |
| −22.201 | −21.219 | 550.700 |
| −23.015 | −22.829 | 550.700 |
| −23.810 | −24.448 | 550.700 |
| −24.585 | −26.077 | 550.700 |
| −25.339 | −27.715 | 550.700 |
| −26.071 | −29.364 | 550.700 |
| −26.778 | −31.023 | 550.700 |
| −27.457 | −32.694 | 550.700 |
| −28.106 | −34.377 | 550.700 |
| −28.723 | −36.072 | 550.700 |
| −29.304 | −37.780 | 550.700 |
| −29.443 | −38.205 | 550.700 |
| −29.560 | −38.636 | 550.700 |
| −29.554 | −39.081 | 550.700 |
| −29.344 | −39.470 | 550.700 |
| −28.968 | −39.705 | 550.700 |
| −28.527 | −39.732 | 550.700 |
| −28.129 | −39.536 | 550.700 |
| −27.821 | −39.213 | 550.700 |
| −27.549 | −38.858 | 550.700 |
| −27.644 | −37.346 | 524.000 |
| −26.536 | −36.059 | 524.000 |
| −25.420 | −34.778 | 524.000 |
| −24.301 | −33.501 | 524.000 |
| −23.184 | −32.221 | 524.000 |
| −22.068 | −30.941 | 524.000 |
| −20.952 | −29.661 | 524.000 |
| −19.835 | −28.382 | 524.000 |
| −18.717 | −27.103 | 524.000 |
| −17.599 | −25.824 | 524.000 |
| −16.481 | −24.546 | 524.000 |
| −15.362 | −23.269 | 524.000 |
| −14.242 | −21.992 | 524.000 |
| −13.122 | −20.715 | 524.000 |
| −12.001 | −19.439 | 524.000 |
| −10.880 | −18.164 | 524.000 |
| −9.758 | −16.888 | 524.000 |
| −8.636 | −15.614 | 524.000 |
| −7.513 | −14.339 | 524.000 |
| −6.389 | −13.066 | 524.000 |
| −5.265 | −11.792 | 524.000 |
| −4.141 | −10.519 | 524.000 |
| −3.016 | −9.247 | 524.000 |
| −1.891 | −7.975 | 524.000 |

TABLE 1-continued

| Axial profile coordinate x [mm] | Circumference profile coordinate y [mm] | Radial profile section height z [mm] |
|---|---|---|
| −0.765 | −6.703 | 524.000 |
| 0.361 | −5.431 | 524.000 |
| 1.487 | −4.160 | 524.000 |
| 2.614 | −2.889 | 524.000 |
| 3.741 | −1.619 | 524.000 |
| 4.869 | −0.349 | 524.000 |
| 5.996 | 0.921 | 524.000 |
| 7.124 | 2.191 | 524.000 |
| 8.253 | 3.460 | 524.000 |
| 9.381 | 4.730 | 524.000 |
| 10.510 | 5.999 | 524.000 |
| 11.639 | 7.268 | 524.000 |
| 12.768 | 8.537 | 524.000 |
| 13.897 | 9.805 | 524.000 |
| 15.026 | 11.074 | 524.000 |
| 16.155 | 12.343 | 524.000 |
| 17.284 | 13.611 | 524.000 |
| 18.413 | 14.880 | 524.000 |
| 19.542 | 16.149 | 524.000 |
| 20.671 | 17.417 | 524.000 |
| 21.800 | 18.686 | 524.000 |
| 22.929 | 19.955 | 524.000 |
| 24.058 | 21.224 | 524.000 |
| 25.186 | 22.494 | 524.000 |
| 26.314 | 23.764 | 524.000 |
| 27.442 | 25.033 | 524.000 |
| 28.569 | 26.304 | 524.000 |
| 29.696 | 27.574 | 524.000 |
| 30.823 | 28.845 | 524.000 |
| 31.949 | 30.117 | 524.000 |
| 33.074 | 31.389 | 524.000 |
| 34.199 | 32.661 | 524.000 |
| 35.323 | 33.935 | 524.000 |
| 36.444 | 35.211 | 524.000 |
| 37.565 | 36.486 | 524.000 |
| 38.691 | 37.758 | 524.000 |
| 38.849 | 37.938 | 524.000 |
| 38.984 | 38.135 | 524.000 |
| 39.041 | 38.365 | 524.000 |
| 38.984 | 38.595 | 524.000 |
| 38.827 | 38.773 | 524.000 |
| 38.607 | 38.860 | 524.000 |
| 38.371 | 38.833 | 524.000 |
| 38.154 | 38.733 | 524.000 |
| 37.947 | 38.612 | 524.000 |
| 36.432 | 37.729 | 524.000 |
| 34.915 | 36.849 | 524.000 |
| 33.405 | 35.958 | 524.000 |
| 31.899 | 35.059 | 524.000 |
| 30.398 | 34.153 | 524.000 |
| 28.901 | 33.238 | 524.000 |
| 27.410 | 32.315 | 524.000 |
| 25.925 | 31.382 | 524.000 |
| 24.446 | 30.440 | 524.000 |
| 22.974 | 29.487 | 524.000 |
| 21.508 | 28.524 | 524.000 |
| 20.051 | 27.549 | 524.000 |
| 18.601 | 26.563 | 524.000 |
| 17.160 | 25.563 | 524.000 |
| 15.728 | 24.551 | 524.000 |
| 14.305 | 23.525 | 524.000 |
| 12.894 | 22.485 | 524.000 |
| 11.493 | 21.429 | 524.000 |
| 10.104 | 20.359 | 524.000 |
| 8.728 | 19.272 | 524.000 |
| 7.364 | 18.169 | 524.000 |
| 6.015 | 17.049 | 524.000 |
| 4.679 | 15.912 | 524.000 |
| 3.359 | 14.758 | 524.000 |
| 2.055 | 13.585 | 524.000 |
| 0.768 | 12.395 | 524.000 |
| −0.502 | 11.185 | 524.000 |
| −1.754 | 9.957 | 524.000 |
| −2.987 | 8.709 | 524.000 |
| −4.199 | 7.443 | 524.000 |

TABLE 1-continued

| Axial profile coordinate x [mm] | Circumference profile coordinate y [mm] | Radial profile section height z [mm] |
|---|---|---|
| −5.391 | 6.156 | 524.000 |
| −6.563 | 4.851 | 524.000 |
| −7.713 | 3.528 | 524.000 |
| −8.842 | 2.186 | 524.000 |
| −9.949 | 0.826 | 524.000 |
| −11.035 | −0.551 | 524.000 |
| −12.099 | −1.945 | 524.000 |
| −13.142 | −3.355 | 524.000 |
| −14.162 | −4.781 | 524.000 |
| −15.161 | −6.223 | 524.000 |
| −16.137 | −7.680 | 524.000 |
| −17.092 | −9.151 | 524.000 |
| −18.025 | −10.636 | 524.000 |
| −18.935 | −12.135 | 524.000 |
| −19.824 | −13.646 | 524.000 |
| −20.692 | −15.171 | 524.000 |
| −21.537 | −16.707 | 524.000 |
| −22.359 | −18.256 | 524.000 |
| −23.157 | −19.818 | 524.000 |
| −23.930 | −21.392 | 524.000 |
| −24.678 | −22.978 | 524.000 |
| −25.401 | −24.576 | 524.000 |
| −26.095 | −26.186 | 524.000 |
| −26.758 | −27.810 | 524.000 |
| −27.389 | −29.446 | 524.000 |
| −27.985 | −31.095 | 524.000 |
| −28.544 | −32.757 | 524.000 |
| −29.063 | −34.432 | 524.000 |
| −29.542 | −36.119 | 524.000 |
| −29.653 | −36.539 | 524.000 |
| −29.729 | −36.965 | 524.000 |
| −29.680 | −37.393 | 524.000 |
| −29.458 | −37.761 | 524.000 |
| −29.103 | −38.005 | 524.000 |
| −28.679 | −38.071 | 524.000 |
| −28.268 | −37.942 | 524.000 |
| −27.932 | −37.670 | 524.000 |
| −27.644 | −37.346 | 524.000 |
| −27.644 | −36.148 | 501.100 |
| −26.515 | −34.963 | 501.100 |
| −25.385 | −33.779 | 501.100 |
| −24.254 | −32.595 | 501.100 |
| −23.123 | −31.413 | 501.100 |
| −21.991 | −30.231 | 501.100 |
| −20.857 | −29.050 | 501.100 |
| −19.723 | −27.870 | 501.100 |
| −18.588 | −26.691 | 501.100 |
| −17.453 | −25.512 | 501.100 |
| −16.316 | −24.334 | 501.100 |
| −15.179 | −23.157 | 501.100 |
| −14.041 | −21.981 | 501.100 |
| −12.902 | −20.806 | 501.100 |
| −11.762 | −19.631 | 501.100 |
| −10.621 | −18.458 | 501.100 |
| −9.480 | −17.285 | 501.100 |
| −8.338 | −16.113 | 501.100 |
| −7.195 | −14.941 | 501.100 |
| −6.051 | −13.771 | 501.100 |
| −4.906 | −12.601 | 501.100 |
| −3.760 | −11.432 | 501.100 |
| −2.613 | −10.264 | 501.100 |
| −1.466 | −9.097 | 501.100 |
| −0.318 | −7.931 | 501.100 |
| 0.831 | −6.766 | 501.100 |
| 1.981 | −5.601 | 501.100 |
| 3.132 | −4.437 | 501.100 |
| 4.284 | −3.274 | 501.100 |
| 5.436 | −2.112 | 501.100 |
| 6.590 | −0.951 | 501.100 |
| 7.744 | 0.209 | 501.100 |
| 8.900 | 1.369 | 501.100 |
| 10.056 | 2.527 | 501.100 |
| 11.213 | 3.684 | 501.100 |
| 12.371 | 4.841 | 501.100 |
| 13.530 | 5.997 | 501.100 |

TABLE 1-continued

| Axial profile coordinate x [mm] | Circumference profile coordinate y [mm] | Radial profile section height z [mm] |
|---|---|---|
| 14.689 | 7.152 | 501.100 |
| 15.850 | 8.306 | 501.100 |
| 17.011 | 9.459 | 501.100 |
| 18.173 | 10.612 | 501.100 |
| 19.336 | 11.764 | 501.100 |
| 20.499 | 12.915 | 501.100 |
| 21.663 | 14.066 | 501.100 |
| 22.828 | 15.215 | 501.100 |
| 23.993 | 16.365 | 501.100 |
| 25.159 | 17.514 | 501.100 |
| 26.325 | 18.662 | 501.100 |
| 27.492 | 19.810 | 501.100 |
| 28.658 | 20.958 | 501.100 |
| 29.826 | 22.105 | 501.100 |
| 30.993 | 23.252 | 501.100 |
| 32.160 | 24.399 | 501.100 |
| 33.327 | 25.547 | 501.100 |
| 34.492 | 26.696 | 501.100 |
| 35.657 | 27.846 | 501.100 |
| 36.823 | 28.995 | 501.100 |
| 37.989 | 30.143 | 501.100 |
| 39.157 | 31.289 | 501.100 |
| 40.327 | 32.434 | 501.100 |
| 40.493 | 32.599 | 501.100 |
| 40.631 | 32.787 | 501.100 |
| 40.693 | 33.011 | 501.100 |
| 40.650 | 33.238 | 501.100 |
| 40.513 | 33.425 | 501.100 |
| 40.309 | 33.535 | 501.100 |
| 40.077 | 33.544 | 501.100 |
| 39.852 | 33.478 | 501.100 |
| 39.637 | 33.388 | 501.100 |
| 38.052 | 32.720 | 501.100 |
| 36.464 | 32.057 | 501.100 |
| 34.883 | 31.381 | 501.100 |
| 33.305 | 30.696 | 501.100 |
| 31.731 | 30.002 | 501.100 |
| 30.161 | 29.299 | 501.100 |
| 28.596 | 28.585 | 501.100 |
| 27.036 | 27.860 | 501.100 |
| 25.482 | 27.124 | 501.100 |
| 23.933 | 26.375 | 501.100 |
| 22.391 | 25.613 | 501.100 |
| 20.856 | 24.838 | 501.100 |
| 19.328 | 24.047 | 501.100 |
| 17.808 | 23.241 | 501.100 |
| 16.297 | 22.419 | 501.100 |
| 14.796 | 21.580 | 501.100 |
| 13.305 | 20.723 | 501.100 |
| 11.824 | 19.847 | 501.100 |
| 10.355 | 18.952 | 501.100 |
| 8.899 | 18.036 | 501.100 |
| 7.457 | 17.099 | 501.100 |
| 6.029 | 16.140 | 501.100 |
| 4.616 | 15.159 | 501.100 |
| 3.220 | 14.154 | 501.100 |
| 1.842 | 13.125 | 501.100 |
| 0.482 | 12.071 | 501.100 |
| −0.859 | 10.994 | 501.100 |
| −2.179 | 9.891 | 501.100 |
| −3.477 | 8.763 | 501.100 |
| −4.753 | 7.608 | 501.100 |
| −6.004 | 6.428 | 501.100 |
| −7.231 | 5.223 | 501.100 |
| −8.433 | 3.992 | 501.100 |
| −9.609 | 2.737 | 501.100 |
| −10.760 | 1.459 | 501.100 |
| −11.884 | 0.157 | 501.100 |
| −12.981 | −1.168 | 501.100 |
| −14.052 | −2.514 | 501.100 |
| −15.095 | −3.882 | 501.100 |
| −16.112 | −5.269 | 501.100 |
| −17.100 | −6.677 | 501.100 |
| −18.061 | −8.103 | 501.100 |
| −18.995 | −9.548 | 501.100 |

TABLE 1-continued

| Axial profile coordinate x [mm] | Circumference profile coordinate y [mm] | Radial profile section height z [mm] |
|---|---|---|
| −19.901 | −11.010 | 501.100 |
| −20.780 | −12.489 | 501.100 |
| −21.631 | −13.984 | 501.100 |
| −22.454 | −15.494 | 501.100 |
| −23.248 | −17.020 | 501.100 |
| −24.011 | −18.562 | 501.100 |
| −24.744 | −20.118 | 501.100 |
| −25.445 | −21.689 | 501.100 |
| −26.113 | −23.274 | 501.100 |
| −26.745 | −24.873 | 501.100 |
| −27.338 | −26.488 | 501.100 |
| −27.890 | −28.117 | 501.100 |
| −28.399 | −29.760 | 501.100 |
| −28.862 | −31.417 | 501.100 |
| −29.277 | −33.086 | 501.100 |
| −29.642 | −34.767 | 501.100 |
| −29.726 | −35.181 | 501.100 |
| −29.766 | −35.601 | 501.100 |
| −29.690 | −36.015 | 501.100 |
| −29.471 | −36.374 | 501.100 |
| −29.133 | −36.623 | 501.100 |
| −28.725 | −36.724 | 501.100 |
| −28.311 | −36.656 | 501.100 |
| −27.951 | −36.438 | 501.100 |
| −27.644 | −36.148 | 501.100 |
| −27.694 | −35.614 | 485.300 |
| −26.560 | −34.483 | 485.300 |
| −25.433 | −33.347 | 485.300 |
| −24.303 | −32.213 | 485.300 |
| −23.172 | −31.081 | 485.300 |
| −22.040 | −29.949 | 485.300 |
| −20.907 | −28.818 | 485.300 |
| −19.773 | −27.689 | 485.300 |
| −18.637 | −26.561 | 485.300 |
| −17.500 | −25.434 | 485.300 |
| −16.361 | −24.309 | 485.300 |
| −15.221 | −23.185 | 485.300 |
| −14.080 | −22.063 | 485.300 |
| −12.936 | −20.943 | 485.300 |
| −11.790 | −19.826 | 485.300 |
| −10.642 | −18.711 | 485.300 |
| −9.492 | −17.597 | 485.300 |
| −8.340 | −16.486 | 485.300 |
| −7.187 | −15.376 | 485.300 |
| −6.032 | −14.268 | 485.300 |
| −4.875 | −13.162 | 485.300 |
| −3.716 | −12.057 | 485.300 |
| −2.555 | −10.955 | 485.300 |
| −1.392 | −9.855 | 485.300 |
| −0.227 | −8.758 | 485.300 |
| 0.940 | −7.662 | 485.300 |
| 2.110 | −6.569 | 485.300 |
| 3.281 | −5.479 | 485.300 |
| 4.455 | −4.391 | 485.300 |
| 5.632 | −3.305 | 485.300 |
| 6.811 | −2.222 | 485.300 |
| 7.991 | −1.142 | 485.300 |
| 9.174 | −0.063 | 485.300 |
| 10.358 | 1.015 | 485.300 |
| 11.544 | 2.090 | 485.300 |
| 12.731 | 3.163 | 485.300 |
| 13.920 | 4.235 | 485.300 |
| 15.110 | 5.305 | 485.300 |
| 16.302 | 6.373 | 485.300 |
| 17.496 | 7.440 | 485.300 |
| 18.691 | 8.504 | 485.300 |
| 19.888 | 9.568 | 485.300 |
| 21.086 | 10.629 | 485.300 |
| 22.286 | 11.689 | 485.300 |
| 23.487 | 12.747 | 485.300 |
| 24.689 | 13.804 | 485.300 |
| 25.893 | 14.858 | 485.300 |
| 27.099 | 15.911 | 485.300 |
| 28.305 | 16.963 | 485.300 |
| 29.513 | 18.013 | 485.300 |

TABLE 1-continued

| Axial profile coordinate x [mm] | Circumference profile coordinate y [mm] | Radial profile section height z [mm] |
|---|---|---|
| 30.722 | 19.063 | 485.300 |
| 31.931 | 20.111 | 485.300 |
| 33.142 | 21.159 | 485.300 |
| 34.352 | 22.206 | 485.300 |
| 35.563 | 23.253 | 485.300 |
| 36.774 | 24.300 | 485.300 |
| 37.985 | 25.346 | 485.300 |
| 39.194 | 26.395 | 485.300 |
| 40.404 | 27.444 | 485.300 |
| 41.617 | 28.488 | 485.300 |
| 41.790 | 28.642 | 485.300 |
| 41.932 | 28.824 | 485.300 |
| 41.997 | 29.044 | 485.300 |
| 41.964 | 29.272 | 485.300 |
| 41.841 | 29.467 | 485.300 |
| 41.648 | 29.591 | 485.300 |
| 41.420 | 29.622 | 485.300 |
| 41.193 | 29.581 | 485.300 |
| 40.972 | 29.511 | 485.300 |
| 39.341 | 28.999 | 485.300 |
| 37.709 | 28.492 | 485.300 |
| 36.082 | 27.971 | 485.300 |
| 34.457 | 27.441 | 485.300 |
| 32.835 | 26.902 | 485.300 |
| 31.217 | 26.353 | 485.300 |
| 29.602 | 25.794 | 485.300 |
| 27.991 | 25.223 | 485.300 |
| 26.385 | 24.641 | 485.300 |
| 24.783 | 24.045 | 485.300 |
| 23.187 | 23.435 | 485.300 |
| 21.596 | 22.809 | 485.300 |
| 20.012 | 22.168 | 485.300 |
| 18.435 | 21.510 | 485.300 |
| 16.865 | 20.834 | 485.300 |
| 15.304 | 20.139 | 485.300 |
| 13.752 | 19.424 | 485.300 |
| 12.210 | 18.687 | 485.300 |
| 10.679 | 17.927 | 485.300 |
| 9.161 | 17.143 | 485.300 |
| 7.656 | 16.333 | 485.300 |
| 6.166 | 15.497 | 485.300 |
| 4.691 | 14.633 | 485.300 |
| 3.235 | 13.739 | 485.300 |
| 1.796 | 12.817 | 485.300 |
| 0.378 | 11.864 | 485.300 |
| −1.020 | 10.880 | 485.300 |
| −2.394 | 9.865 | 485.300 |
| −3.745 | 8.817 | 485.300 |
| −5.069 | 7.737 | 485.300 |
| −6.365 | 6.623 | 485.300 |
| −7.634 | 5.479 | 485.300 |
| −8.874 | 4.302 | 485.300 |
| −10.084 | 3.096 | 485.300 |
| −11.264 | 1.860 | 485.300 |
| −12.413 | 0.595 | 485.300 |
| −13.530 | −0.698 | 485.300 |
| −14.617 | −2.017 | 485.300 |
| −15.673 | −3.361 | 485.300 |
| −16.698 | −4.728 | 485.300 |
| −17.693 | −6.118 | 485.300 |
| −18.658 | −7.528 | 485.300 |
| −19.592 | −8.959 | 485.300 |
| −20.497 | −10.409 | 485.300 |
| −21.371 | −11.877 | 485.300 |
| −22.215 | −13.363 | 485.300 |
| −23.028 | −14.866 | 485.300 |
| −23.808 | −16.387 | 485.300 |
| −24.554 | −17.925 | 485.300 |
| −25.265 | −19.478 | 485.300 |
| −25.940 | −21.048 | 485.300 |
| −26.579 | −22.633 | 485.300 |
| −27.179 | −24.234 | 485.300 |
| −27.736 | −25.849 | 485.300 |
| −28.248 | −27.479 | 485.300 |
| −28.709 | −29.125 | 485.300 |

TABLE 1-continued

| Axial profile coordinate x [mm] | Circumference profile coordinate y [mm] | Radial profile section height z [mm] |
|---|---|---|
| −29.115 | −30.785 | 485.300 |
| −29.465 | −32.458 | 485.300 |
| −29.758 | −34.141 | 485.300 |
| −29.820 | −34.555 | 485.300 |
| −29.842 | −34.972 | 485.300 |
| −29.756 | −35.380 | 485.300 |
| −29.532 | −35.731 | 485.300 |
| −29.199 | −35.982 | 485.300 |
| −28.801 | −36.101 | 485.300 |
| −28.386 | −36.067 | 485.300 |
| −28.011 | −35.885 | 485.300 |
| −27.694 | −35.614 | 485.300 |

The blade profile of the blade leaf 12 of the rotor blade 10 according to the invention is described or defined by the profile coordinates or coordinate values x, y and z compiled in the above Table 1 in such a manner that the blade profile lies within a tolerance band of 1 mm in a direction perpendicular to each point on the profile defined by the profile coordinates of Table 1, and/or that the blade profile coincides with the profile defined by the profile coordinates of Table 1, when all profile coordinates or coordinate values x, y and z of Table 1 are scaled with a constant value and/or that the blade profile coincides with the profile defined by the profile coordinates or coordinate values x, y and z of Table 1, when the blade length extending in radial direction of the coordinate value z is cut off radially outside or extrapolated.

The blade profile of the blade leaf 12 of the rotor blade 10 according to the invention accordingly corresponds substantially to the blade profile defined by the profile coordinates or coordinate values x, y and z of Table 1, namely subject to one or multiple of the peripheral conditions that the blade profile lies within the tolerance band of 1 mm in a direction perpendicular to each point on the profile defined by the Table 1, and/or that the blade profile coincides with the profile defined by the profile coordinates of Table 1 when all profile coordinates of Table 1 are multiplied or divided by the constant scale value, and/or that the blade profile coincides with the profile defined by the profile coordinates of Table 1, when the blade length is cut off in radial direction of the coordinate value z or extrapolated.

Preferentially, combined with the above aspect, or alternatively independently thereof, it is provided, according to the invention, that in the region of each radial profile section a maximum profile thickness of the blade profile lies in a section between 45% and 52% of the length of a camber line 18 extending starting out from the flow inlet edge 14 in the direction of the flow outlet edge 15 and running between the pressure side 16 and the suction side 17.

Thus, FIGS. 2 and 3 each show camber lines 18, which extend starting out from the flow inlet edge 14 in the direction of the flow outlet edge 15 of the blade leaf 12, wherein the camber lines 18 in each point of the same in a normal direction to the respective tangent of the camber line 18 have an identical distance from the pressure side 16 and the suction side 17.

In each point of the respective camber line 18 a circle 23 can be accordingly placed which defines the thickness of the blade leaf in the respective radial profile section, wherein the maximum profile thickness lies in the section between 45% and 52% of the length of a camber line 18.

Starting out from the radially inner profile sections on the hub side in the direction of the radial outer profile sections on the housing side, the respective maximum profile thickness here is increasingly shifted in the direction of the flow outlet edge 15. This follows indirectly from FIGS. 2, 3 and 4, wherein it is evident from FIGS. 2, 3 and 4 that the maximum profile thickness of the respective radial profile section shown by the respective circle 23 with increasing shifting of the profile section to radially outside is shifted in the direction of the flow edge 15.

Accordingly, with radially inner profile sections, the maximum profile thickness is located closer to 45% of the length of a camber line 18 and with radially outer profile sections closer to 52% of the length of a camber line 18, however in each case in the range between 45% and 52% of the length of a camber line 18.

Preferably, combined with the two above aspects, it is provided furthermore, according to the invention that in the region of each radial profile section the pressure side 16 of the blade leaf 12 follows an approximately linear course.

An approximately linear course of the pressure side 16 is present when, in the region of the respective radial profile section profile, coordinates or coordinate values x and y of the pressure side 16 lie in a tolerance band 22 about a best-fit straight line 19 approximating the pressure side 16 in the respective profile section. In the detail II shown enlarged in FIG. 2 the best-fit straight line 19 is shown, which is defined by two straight lines 20 and 21 extending parallel to the best-fit straight line 19 and including the best-fit straight line 19. The straight lines 20 and 21 have a distance from the best-fit straight line 19 of a maximum of 0.75 mm, namely in each case perpendicularly to the best-fit straight line 19. The distance between the straight lines 20 and 21 including the best-fit straight line 19 accordingly is a maximum of 1.5 mm.

The respective best-fit straight line 19 can be placed through the coordinate values x and y of the pressure side 16 via the so-called method of the smallest squares. This is a mathematical standard method for best-fit calculation.

With the invention, rotor blades for axial compressors can be provided which have a high choke resistance are accordingly particularly resistant and insensitive to choke flutter.

The rotor blade according to the invention can be produced with production methods as desired.

Typically, the rotor blade 10 according to the invention is employed in a rear compressor stage of an axial compressor for industrial applications.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A rotor blade (10) of an axial compressor, comprising:

a blade root (11), via which the rotor blade is fastenable to a rotor basic body of a rotor of the axial compressor; and a blade leaf (12), configured to provide flow deflection, the blade leaf (12) having:

a flow inlet edge (14), a flow outlet edge (15), a pressure side (16) extending between the flow inlet edge (14) and the flow outlet edge (15), and a suction side (17) extending between the flow inlet edge (14) and the flow outlet edge (15), wherein the flow inlet edge (14), the flow outlet edge (15), the pressure side (16) and the suction side (17) together define a blade profile of the blade leaf (12) in Cartesian coordinate values x, y and z such that first and second profile coordinates, or the coordinates x and y when joining via continuous arcs, each describe a smooth profile section on a radial section height along a third profile coordinate, or the coordinate value z, and the joining of the radial profile sections with a smoothing function describe the blade profile of the blade leaf (12), wherein in the region of each radial profile section a maximum profile thickness lies in a section between 45% and 52% of the length of a camber line (18) extending starting from the flow inlet edge (14) in the direction of the flow outlet edge (15) and running between the pressure side (16) and the suction side (17), and wherein the blade has the following T max/C ratios:

a root portion of the blade has T max/C ratio of 0.15:

a tip portion of the blade has T max/C ratio of 0.05; and a mid portion centered at about sixty percent of the blade has T max/C ratio of 0.07.

2. The rotor blade according to claim 1, wherein starting from radially inner profile sections of the rotor blade in the direction of radially outer profile sections the respective maximum profile thickness is increasingly shifted in the direction of the flow outlet edge (15).

3. A rotor with at least one rotor blade according to claim 1.

4. A compressor with at least one rotor according to claim 1.

* * * * *